US008393560B2

(12) United States Patent
Humble

(10) Patent No.: US 8,393,560 B2
(45) Date of Patent: Mar. 12, 2013

(54) FLUID WASTE CONTAINMENT

(76) Inventor: Erik L. Humble, Otis Orchards, WA (US)

( * ) Notice: Subject to any disclaimer, the term of this patent is extended or adjusted under 35 U.S.C. 154(b) by 284 days.

(21) Appl. No.: 12/928,955

(22) Filed: Dec. 23, 2010

(65) Prior Publication Data

US 2012/0160352 A1 Jun. 28, 2012

(51) Int. Cl.
*B02C 23/36* (2006.01)

(52) U.S. Cl. ..... 241/46.017; 241/285.3

(58) Field of Classification Search .. 241/46.013–46.17, 241/285.1, 285.2, 285.3
See application file for complete search history.

(56) References Cited

U.S. PATENT DOCUMENTS 3,315,903 A * 4/1967 Vernon ..... 241/285.1
6,138,609 A * 10/2000 Gordon ..... 119/166
6,343,752 B1 * 2/2002 Sleasman et al. ..... 241/21
6,708,910 B2 * 3/2004 Moore, Jr. ..... 241/46.11
8,074,911 B2 * 12/2011 Capano et al. ..... 241/46.17

* cited by examiner

*Primary Examiner* — Mark Rosenbaum
(74) *Attorney, Agent, or Firm* — Thomas Olson

(57) ABSTRACT

In one representative example, a portable containment apparatus includes a tank adapted to contain a liquid waste, an inlet through which the liquid waste is introduced into the tank, an outlet through which at least a portion of the contained liquid waste is expelled from the tank, a grinder pump operatively disposed within the tank and adapted to expel the portion of contained liquid waste from the tank, a heater affixed to the tank and adapted to transfer heat energy to the liquid waste contained within the tank, and an electrical distribution box adapted to be removably supported on an exterior surface of the tank. The electrical distribution box is adapted to be selectively stowed within the tank when removed from its supported position on the exterior surface of the tank. The apparatus also includes a receiver system adapted to receive the electrical box in its removably supported position on the exterior of the tank. The apparatus further includes a powder coating affixed to the exterior surface of the tank and to an interior surface of the tank.

9 Claims, 11 Drawing Sheets

FLUID WASTE CONTAINMENT

BACKGROUND

Various types of field operations, such as military field operations for example, often require that personnel remain in the field for extended periods of time. It is often desirable to provide various amenities for use by such personnel. These amenities can include, for example, kitchen facilities, showering/bathing facilities, laundry facilities and restroom facilities. Such facilities can produce various types of fluid waste that is most often in the form of wastewater. For example, kitchen facilities can produce wastewater containing detergent and/or food particles from food preparation and/or utensil washing. Showering/bathing facilities, as well as laundry facilities, can produce wastewater containing detergent and various other contaminants such as various types of dirt and debris. Restroom facilities can produce wastewater containing human waste among other types of contaminants and debris typically found in sewage wastewater. It is desirable to dispose of such wastewater in a reasonably sanitary manner. Various detriments can be associated with conventional means of wastewater disposal in field operations.

DETAILED DESCRIPTION

Figure 1:
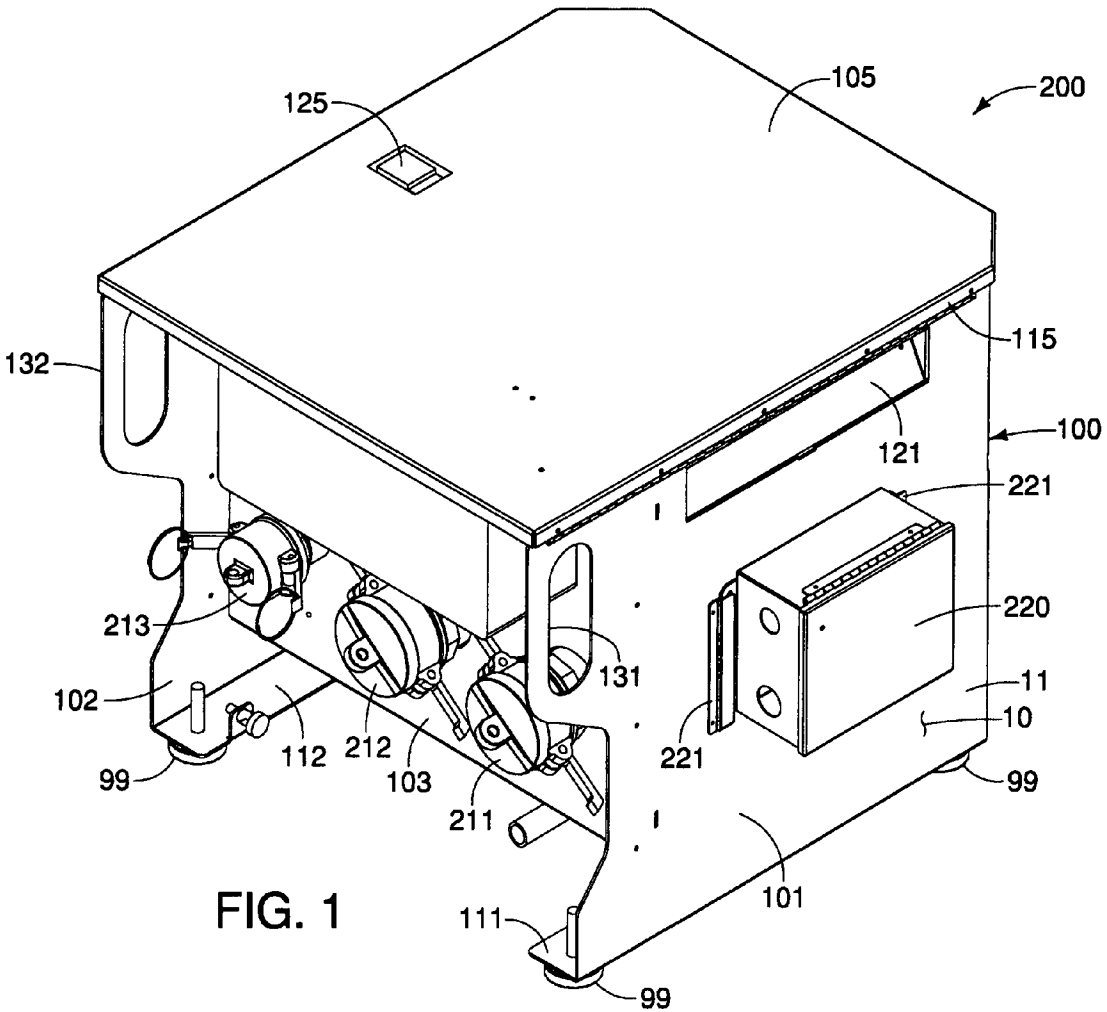
FIG. 1 is an isometric view of an apparatus according to an exemplary embodiment of the disclosure.
Figure 2:
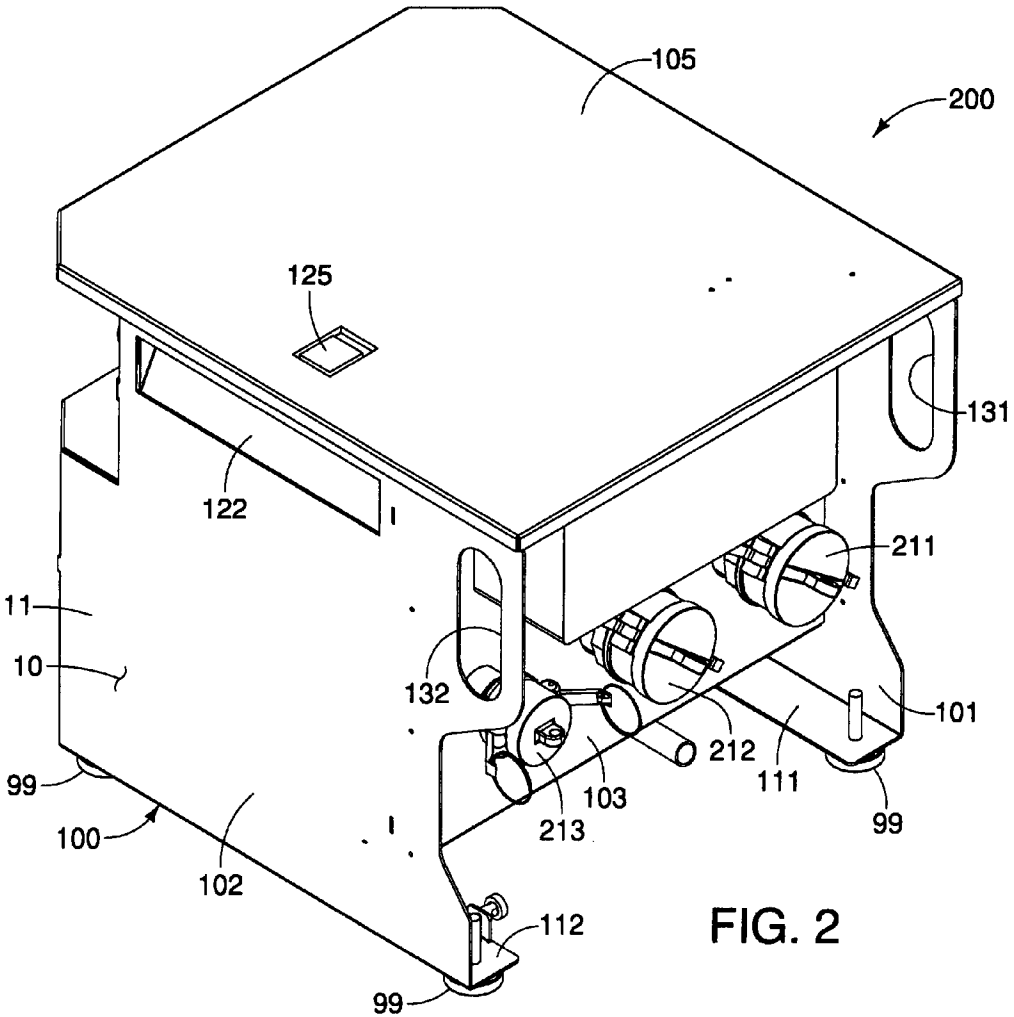
FIG. 2 is another isometric view of the apparatus depicted in FIG. 1.
Figure 3:
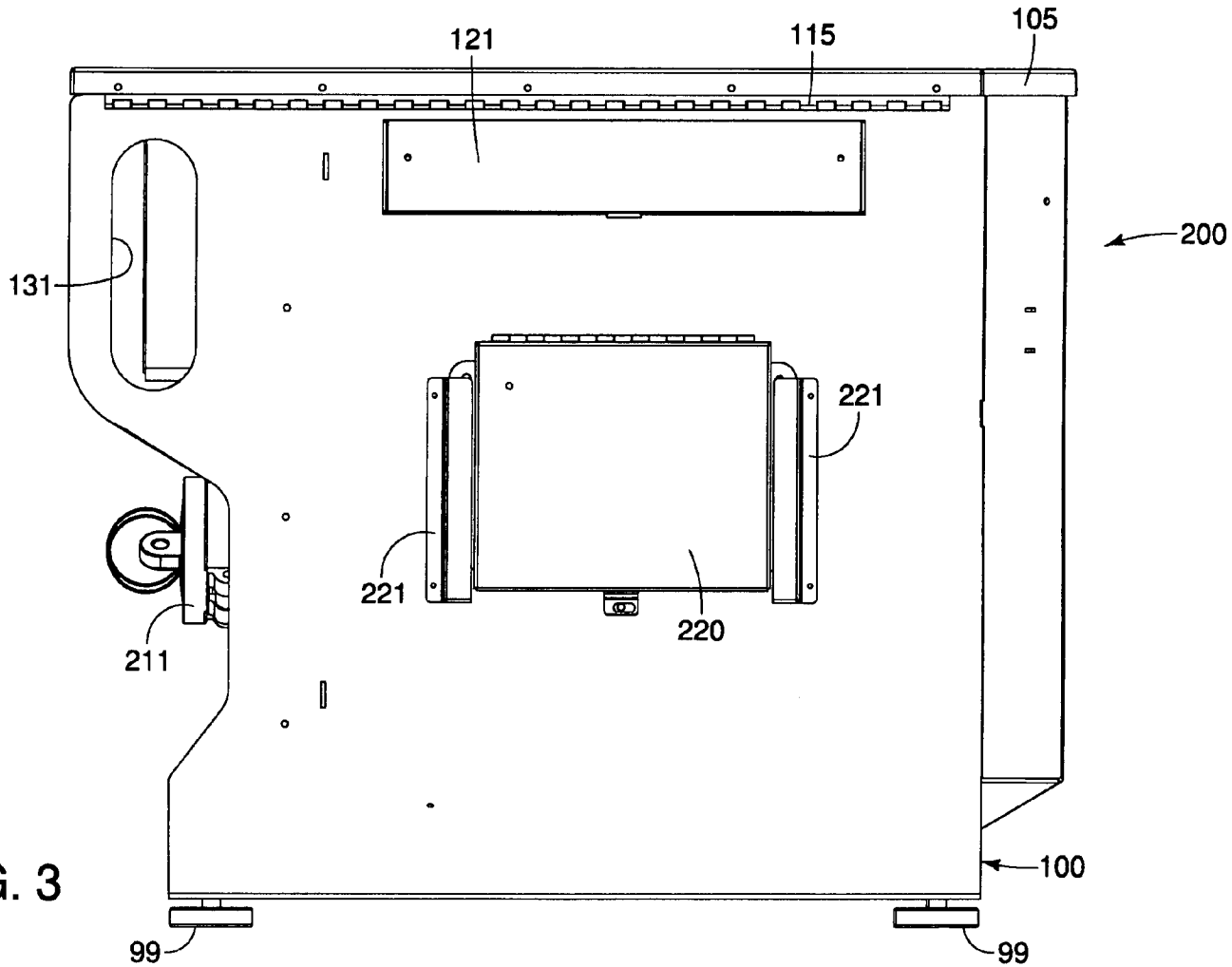
FIG. 3 is a first side elevation view of the apparatus depicted in FIG. 1.
Figure 4:
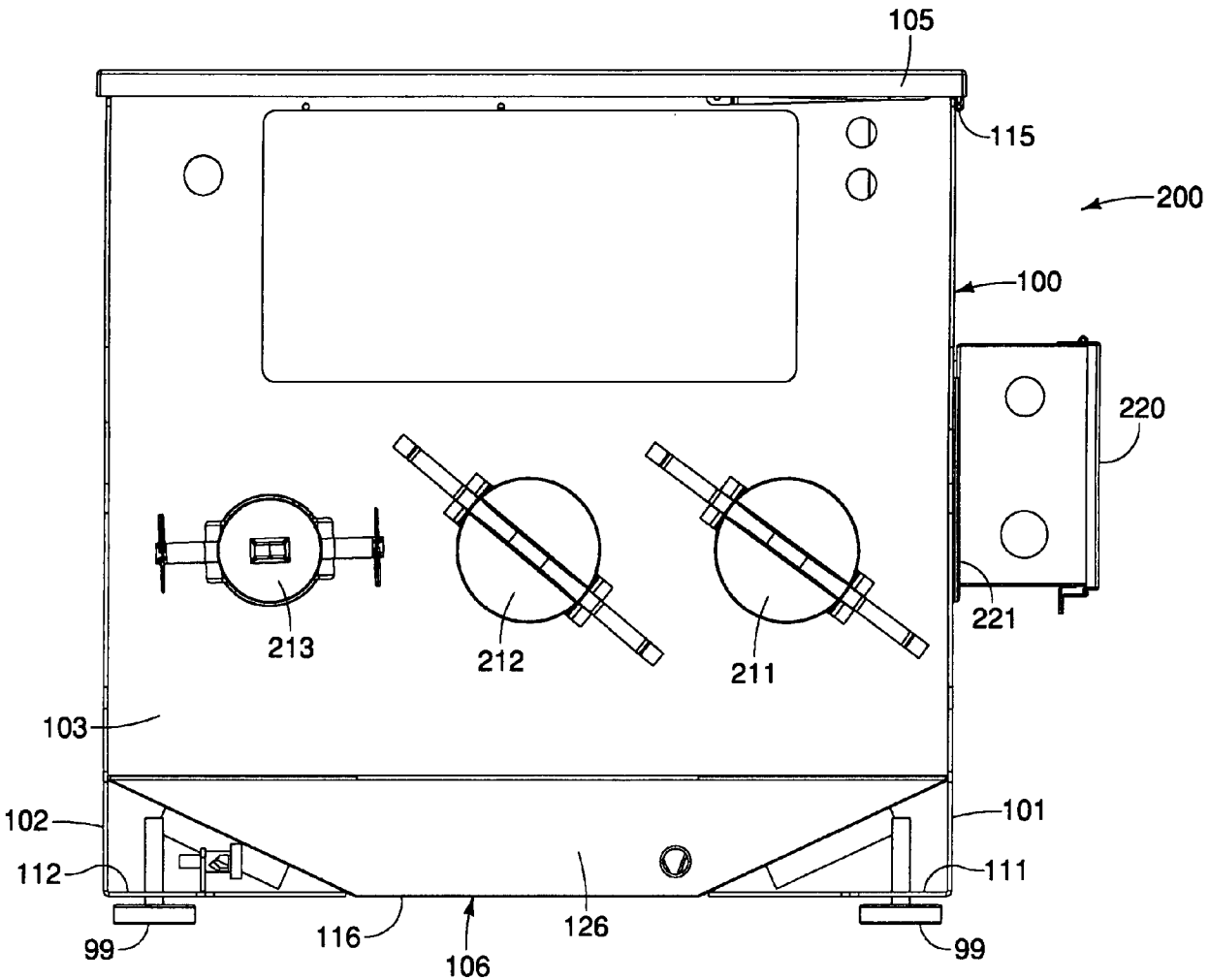
FIG. 4 is front elevation view of the apparatus depicted in FIG. 1.
Figure 5:
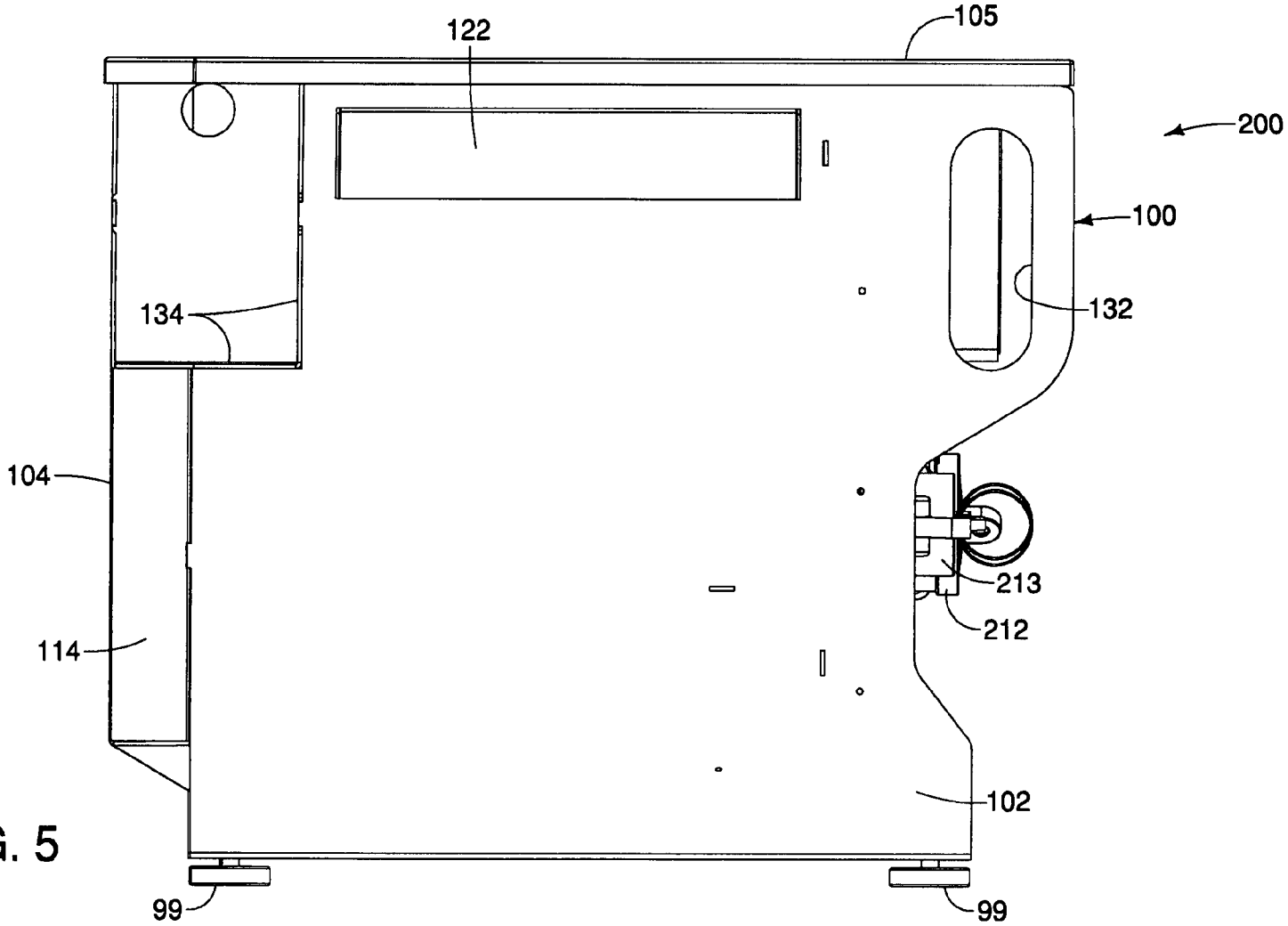
FIG. 5 is a second side elevation view of the apparatus depicted in FIG. 1.

With reference to the drawings, FIG. 1 and FIG. 2 are each isometric views of an apparatus 200 according to an exemplary embodiment of the disclosure, while FIG. 3 is a first side elevation view, FIG. 4 is a front elevation view, and FIG. 5 is a second side elevation view. The apparatus 200 includes a tank 100 that is adapted to contain a liquid waste (not shown) such as, but not limited to sewage and/or drain wastewater. The tank 100 includes first side wall 101 and a second side wall 102. One or more of the first side wall 101 and the second side wall 102 can be substantially flat and planar, as is seen. As is also seen, the first side wall 101 can be substantially parallel with the second side wall 102. More specifically, the second side wall 102 can be in substantially parallel offset juxtaposition relative to the first side wall 101.

The tank 100 includes a front wall 103. The front wall 103 can be substantially flat and planar, as is shown. The front wall 103 can extend substantially between the first side wall 101 and the second side wall 102. The front wall 103 can be in substantially perpendicular orientation relative to the first side wall 101 and to the second side wall 102. The apparatus includes a lid 105. The lid 105 can be substantially flat and planar as shown. The lid 105 can be pivotally attached to the tank 100. According to at least one embodiment of the disclosure, the apparatus 200 includes a pivot device 115 by which the lid is pivotally attached to the tank 100. According to at least one embodiment of the disclosure, the pivot device 115 is connected to the lid 105 and to the tank 100. The pivot device 115 can have one or more of a number of possible specific forms such as, but not limited to, that of a hinge, as shown. The apparatus 200 can include a lid-securing device 125. The lid-securing device 125 can be supported on, or at least partially connected to, the lid 105. The lid securing device 125 can have one or more of a number of possible specific forms such as, but not limited to, that of a latch, as shown. The lid securing device 125 can be adapted to selectively secure the lid 105 in a closed position as shown. More specifically, the lid securing device 125 can be adapted to substantially prevent the lid 105 from pivoting relative to the tank 100 when the lid is in a closed position as shown. Additional aspects of the pivot device 115 and the lid-securing device 125 are described in greater detail herein below.

Still referring to FIGS. 1-5, each of the first side wall 101 and the second side wall 102 can include a respective lower flange 111, 112. Specifically, the first side wall 101 can include a respective first lower flange 111, while the second side wall 102 can include a respective second lower flange 112. One or more of the first lower flange 111 and the second lower flange 112 can extend inwardly from, respectively, the first side wall 101 and the second side wall 102, as shown. More specifically, the first lower flange 111 and the second lower flange 112 can extend substantially toward each other, as shown. The apparatus 200 can include one or more feet 99 configured to support the apparatus on a support surface (not shown) such as a floor or the ground. According to the exemplary embodiment of the disclosure, one or more of the feet 99 can be supported on and/or connected to one or more of the lower flanges 111, 112, as shown. The feet 99 can be height-adjustable to accommodate an uneven support surface.

The apparatus 200 can include one or more handholds or handles adapted to facilitate handling of the apparatus. According to the exemplary embodiment of the disclosure, the apparatus 200 can include one or more hand holds or handles such as an upper first hand hold 121 (shown in FIGS. 1 and 3) and an upper second hand hold 122 (shown in FIGS. 2 and 5). The upper first hand hold 121 can be formed in the first side wall 101 as depicted. Likewise, the upper second hand hold 122 can be formed in the second side wall 102 as depicted. Each of the upper first hand hold 121 and upper second hand hold 122 can be substantially flush, respectively, with the first side wall 101 and the second side wall 102, as shown. Each of the upper first hand hold 121 and upper second hand hold 122 can be adapted for manual lifting and/or handling of the apparatus 200. The apparatus 200 can have handles or hand holds of varying and/or differing configuration. For example, the exemplary apparatus includes a first corner handle 131 (shown in FIGS. 1, 2, 3 and 5) and a second corner handle 132 (shown in FIGS. 1, 2, 3 and 5). Each of the first corner handle 131 and the second corner handle 132 can be at least partially defined by a respective opening through the respective side wall 101, 102 as shown. More specifically, one of more of the first corner handle 131 and the second corner handle 132 can be substantially integral with the first side wall 101 and the second side wall 102, respectively. According to the exemplary embodiment of the disclosure, the first corner handle 131 and the second corner handle 132 substantially protrude from the front wall 103 as depicted.

With continued reference to FIGS. 1-5, the apparatus 200 can include at least one inlet through which at least one substance, such as fluid or liquid waste, can be introduced into the tank 100. According to the exemplary embodiment of the disclosure, the apparatus 200 includes a first inlet 211, a second inlet 212, and a third inlet 213. As shown, each of the inlets 211, 212, 213 can include and/or can be substantially in the form of pipe and/or hose couplings and/or connections to facilitate coupling and/or connecting of hoses and/or supply lines and/or pipes (not shown) to the apparatus. Each of the inlets 211, 212, 213 can be of a respective size. For example, according to the exemplary embodiment of the disclosure, the first inlet 211 and the second inlet 212 are of a size that is larger than that of the third inlet 213, as shown. According to the exemplary embodiment of the disclosure, one or more of the inlets 211, 212, 213 include or are substantially in the form of a standardized coupling or connection. More specifically, according to at least one embodiment of the disclosure, the first and second inlets 211, 212 are of a three-inch nominal connection size, while the third inlet 213 is of a two-inch nominal connection size. As is seen from a study of FIG. 105, each of the inlets 211, 212, 213 is located through the front wall 101. However, other alternative locations of one or more of the inlets 211, 212, 213 are possible according to alternative embodiments of the disclosure not specifically described or depicted herein.

With continued reference to FIGS. 1-5, the tank 100 has an exterior surface 10. The tank 100 and/or other components of the apparatus 200 can have a coating applied thereto. For example, the tank 100 can have a coating 11 applied to the exterior surface 10 thereof. According to the exemplary embodiment of the disclosure, the coating can be a powder coating such as that known by the name Innotek® (part number G17SX106S70-40) available from Innotek Powder Coatings, LLC, 3400 West 7$^{th}$ Street, Big Spring, Tex.

With reference now to FIGS. 1 and 3, the apparatus 200 can include an electrical distribution box 220. The electrical distribution box 220 can be adapted to be removably supported on the exterior surface 10. More specifically, the electrical distribution box 220 can be adapted to be removably supported on the exterior surface 10 at a predetermined side wall, such as, for example, the first side wall 101, as shown. Other locations of the removably supported electrical distribution box 220 are possible in accordance with alternative embodiments of the disclosure that are not specifically described and/or shown herein. The apparatus 200 can include a receiver system 221. The receiver system 221 can be attached or connected to the exterior surface 10 at a predetermined side wall, such as the first side wall 101, as shown. The receiver system 221 is adapted to receive the electrical box 220 in a removably supported position. For example, the receiver system 221 can be adapted to receive the electrical box 220 in the removably supported position shown in the accompanying figures. According to the exemplary embodiment of the disclosure, the receiver system 221 is substantially in the form of a pair of spaced apart, juxtaposed rails affixed to the exterior surface 10 and adapted to slidably receive the electrical box 220. In this manner, for example, the electrical box 220 can be selectively removed from its supported position on the exterior 10 so as to be stowed within the tank 100 during storage and/or transportation of the apparatus 200.

Figure 6:
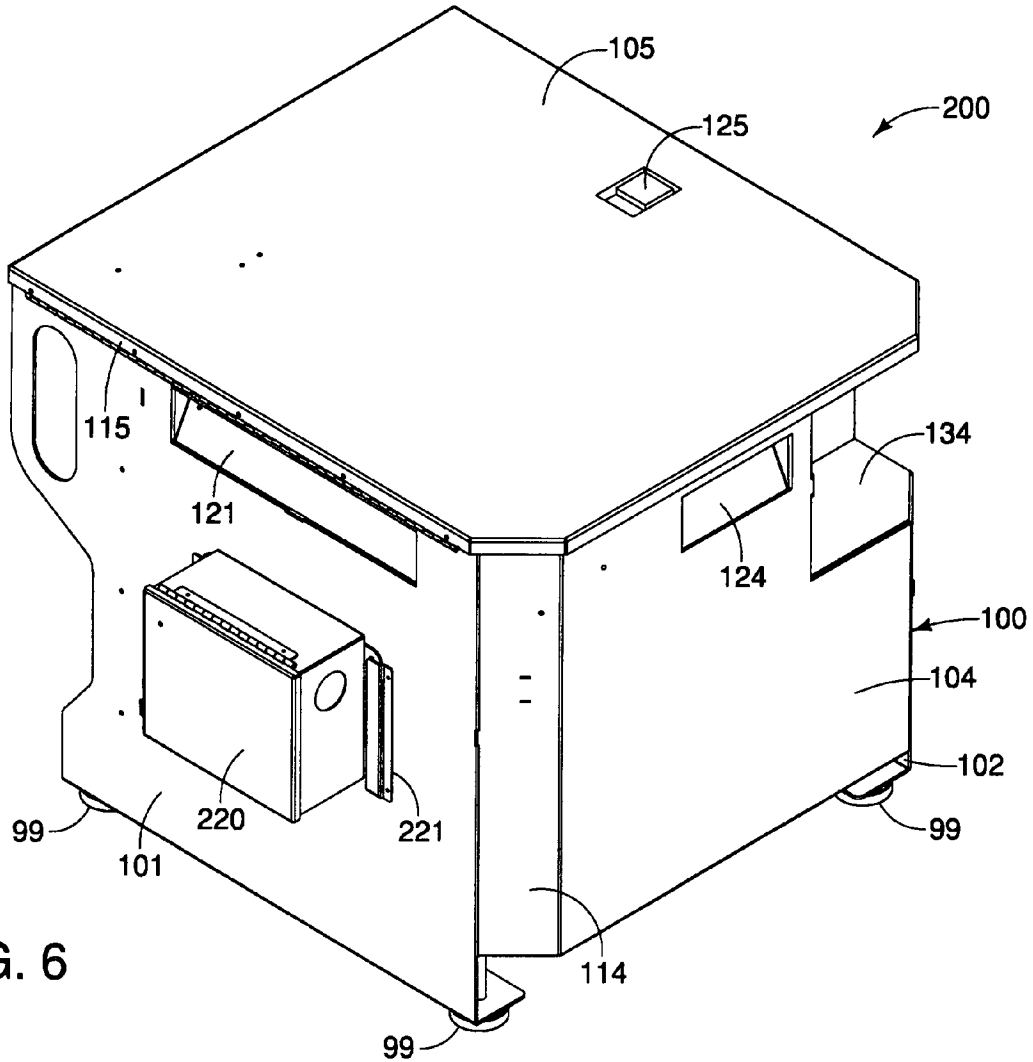
FIG. 6 is another isometric view of the apparatus depicted in FIG. 1.
Figure 7:
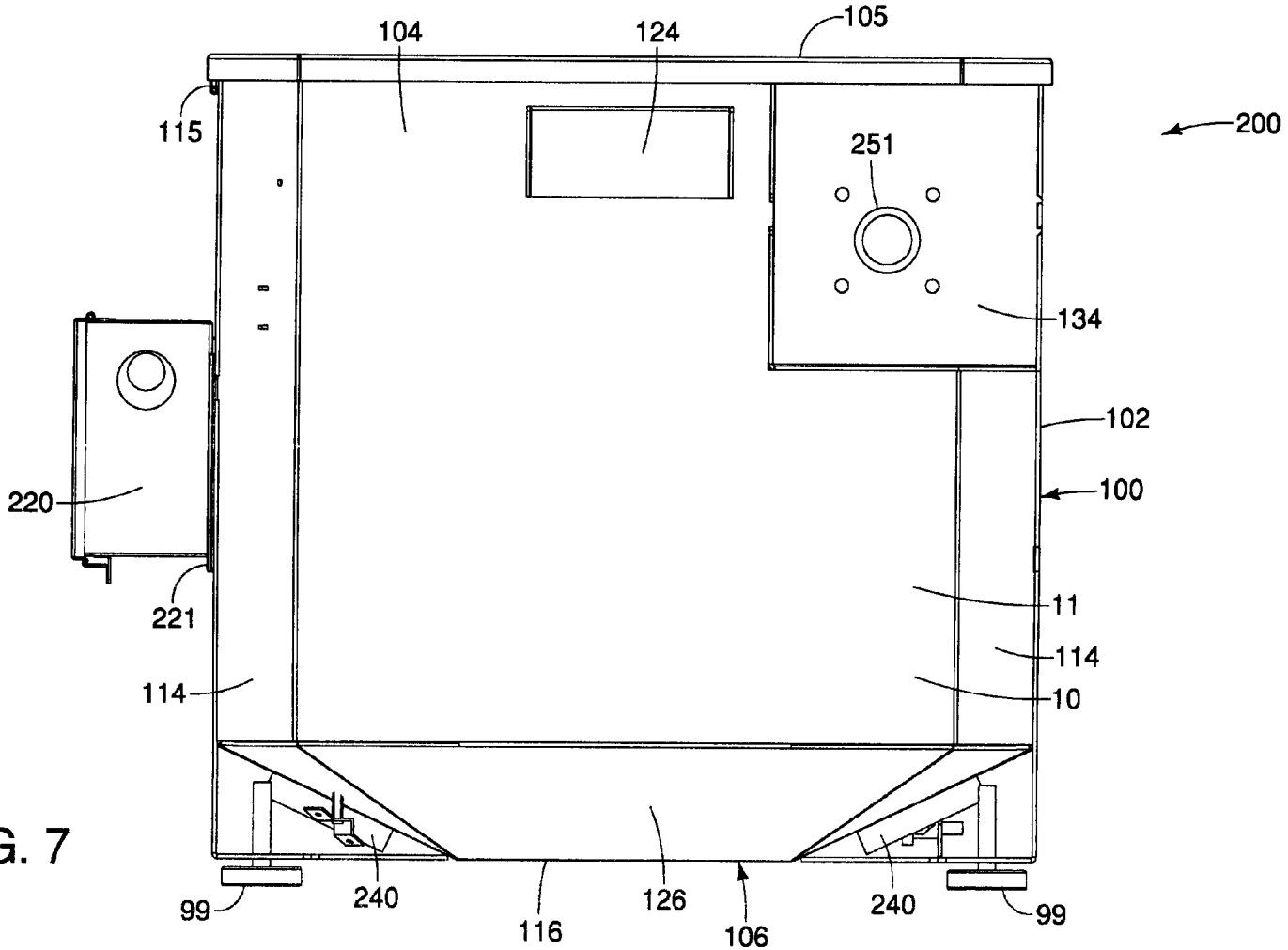
FIG. 7 is a rear elevation view of the apparatus depicted in FIG. 1.

With continued reference to the drawings, FIG. 6 is an isometric view of the apparatus 200, while FIG. 7 is a rear elevation view. As is seen, the tank 100 can include a rear wall 104. The rear wall 104 can extend substantially between the first side wall 101 and the second side wall 102. The rear wall 104 can be substantially flat and planar as shown. The rear wall is in substantially parallel offset juxtaposition relative to the front wall 103 (shown in FIGS. 1, 2 and 4) according to the exemplary embodiment of the disclosure. One or more of the walls 101, 102, 103, 104 can include at least one beveled portion. According to the exemplary embodiment of the disclosure, as is seen in FIGS. 6 and 7, the rear wall 104 includes a pair of beveled portions 114. Similarly, one or more of the walls 101, 102, 103, 104 can include at least one notched portion. According to the exemplary embodiment of the disclosure, the rear wall 104 includes a notched portion 134. The rear wall 104 can define a rear handle or hand hold 124, as shown. The rear handhold 124 can be substantially flush with the rear wall 104 according to the exemplary embodiment of the disclosure. The rear handhold 124 can be adapted for manually lifting and/or handling the apparatus 200.

With reference to FIG. 7, the apparatus 200 can include an outlet 251. According to the exemplary embodiment of the disclosure, at least a portion of contents of the tank 100 can be expelled from the tank through the outlet 251. The outlet 251 can be located through the rear wall 104, as shown. More specifically, and with reference to both FIGS. 6 and 7, the outlet 251 (shown in FIG. 7) is located in the notched portion 134 of the rear wall 104 according to the exemplary embodiment of the disclosure. However, it is to be understood that the outlet 251 can have one of a number of possible locations according to respective alternative configurations not specifically described and/or depicted herein. The outlet 251 can include and/or be substantially in the form of one or more types of fittings, connections and/or couplings (not shown) to facilitate attachment, connection and/or coupling of one or more hoses, pipes and/or lines into which, or through which, at least a portion of contents of the tank 100 are intended to be expelled.

Figure 8:
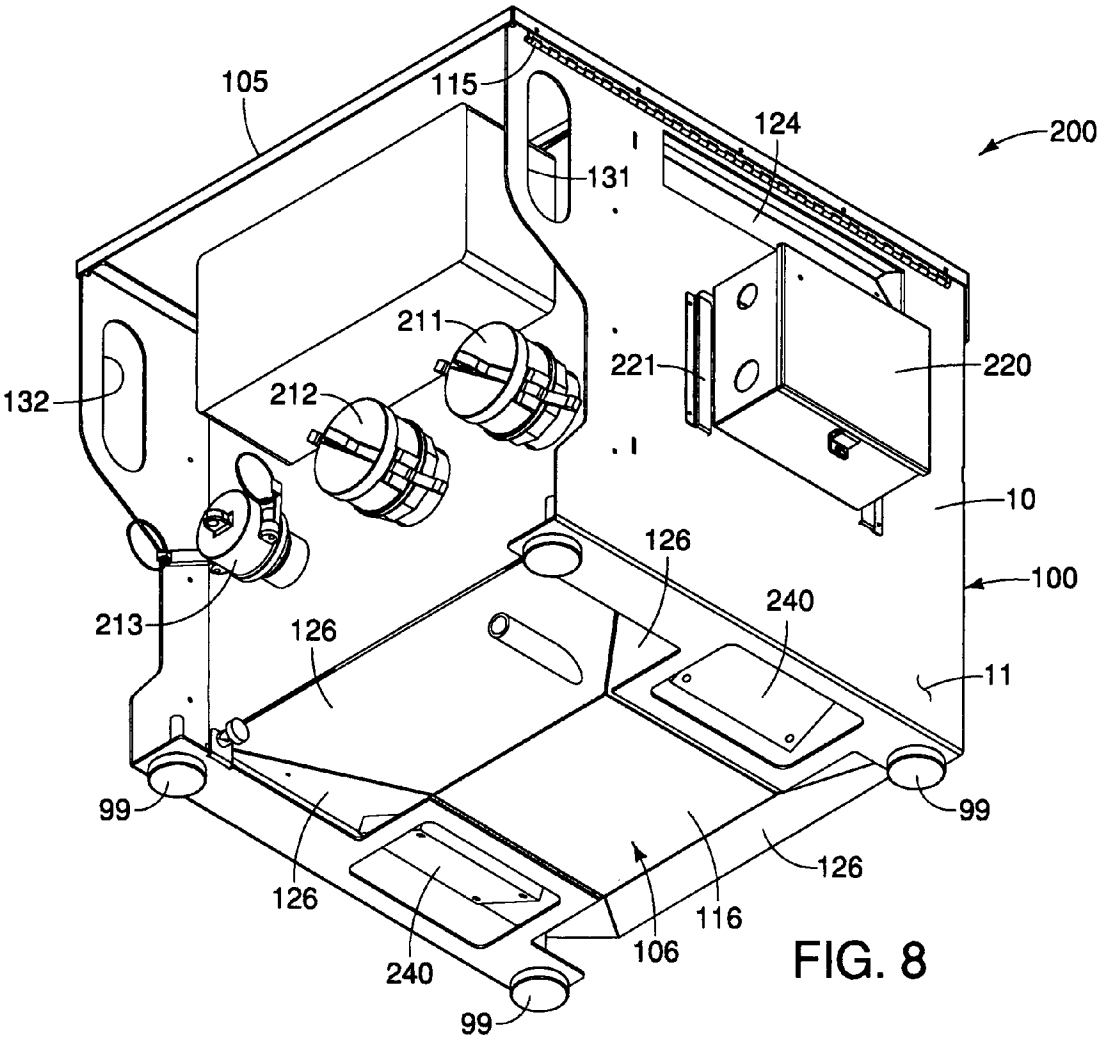
FIG. 8 is another isometric view of the apparatus depicted in FIG. 1.
Figure 9:
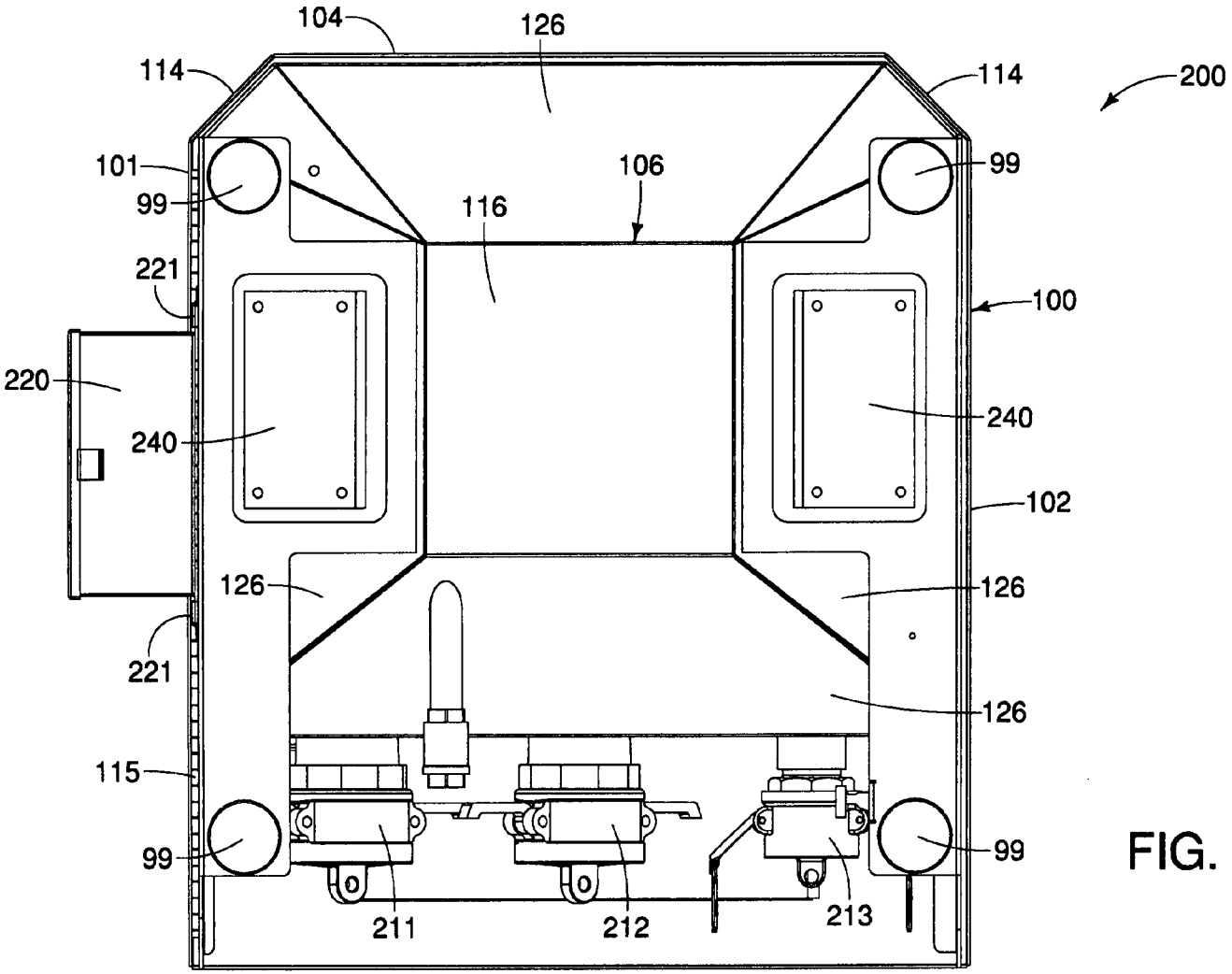
FIG. 9 is a bottom view of the apparatus depicted in FIG. 1.

With further reference to the drawings, FIG. 8 is yet another isometric view of the apparatus 200, while FIG. 9 is a bottom view of the apparatus. As is shown, the tank 100 includes a bottom wall 106. According to at least one embodiment of the disclosure, the bottom wall 106 extends between the first side wall 101, the second side wall 102, the front wall 103 and the rear wall 104. The bottom wall 106 can include a center portion 116 and at least one outer portion 126 positioned between the center portion and at least one of the side walls 101, 102 and/or one of the front wall 103 and/or rear wall 104. According to the exemplary embodiment of the disclosure, the bottom wall 106 includes a substantially flat, planar center portion 116 and a plurality of sloped outer portions 126 substantially surrounding the center portion. Specifically, the bottom wall 106 can include a center portion 116 and four outer portions or facets 126, which together surround the center portion. One or more of the outer portions 126 can be substantially flat and planar. As is seen from a study of FIGS. 8 and 9, each of the outer portions 126 of the bottom wall 106 can substantially adjoin a respective side wall 101, 102, front wall 103 and rear wall 104. The outer portions 126 can be sloped or otherwise positioned and/or configured so that a sump or low area of the tank 100 is defined substantially over the center portion 116 as is particularly evident from a study of FIG. 8.

Each of the first side wall 101, the second side wall 102, the front wall 103, the rear wall 104, the lid 105 and the bottom wall 106, including respective portions thereof, whether or not specifically identified and/or described herein, can be fabricated from one or more of a number of materials. For example, one or more of the aforementioned components and/or portions thereof can be fabricated from a metal such as, for example, aluminum alloy or steel. One or more of the aforementioned components and/or portions thereof can be fabricated from a sheet material or a plate material, for example. According to the exemplary embodiment of the disclosure, one or more of the aforementioned components and/or portions thereof are fabricated from respective metal plate material or metal sheet material. Joined together by appropriate means such as by welding.

Further reference to FIGS. 8 and 9 reveals that the apparatus 200 can include at least one heater 240. According to the exemplary embodiment of the disclosure, the apparatus 200 includes two heaters 240, as shown. The heater 240 can be affixed to the exterior surface 10 of the tank 100. More specifically, the heater 240 can be affixed to the exterior surface 10 of the tank 100 at the bottom wall 106, as shown. As is seen from a study of FIGS. 8 and 9, the heater 240 can be affixed to a respective outer portion 126 of the bottom wall 106. According to the exemplary embodiment of the disclosure, each of two heaters 240 is affixed to an associated outer portion 126 of the bottom wall 106 which is adjacent, respectively, to the first side wall 101 and to the second side wall 102, as shown. The heater 240 can be adapted to transfer heat energy to contents of the tank 100. Specifically, the heater 240 is adapted to substantially prevent contents of the tank from freezing during exposure to ambient temperatures within a predetermined range. A portion of the coating 11 can be omitted from an area of the exterior surface 10 of the tank 100 at which area the respective heater 240 is located in order to promote transfer of heat energy from the heater to contents of the tank. According to the exemplary embodiment of the disclosure, the heater 240 is electrically powered.

Figure 10:
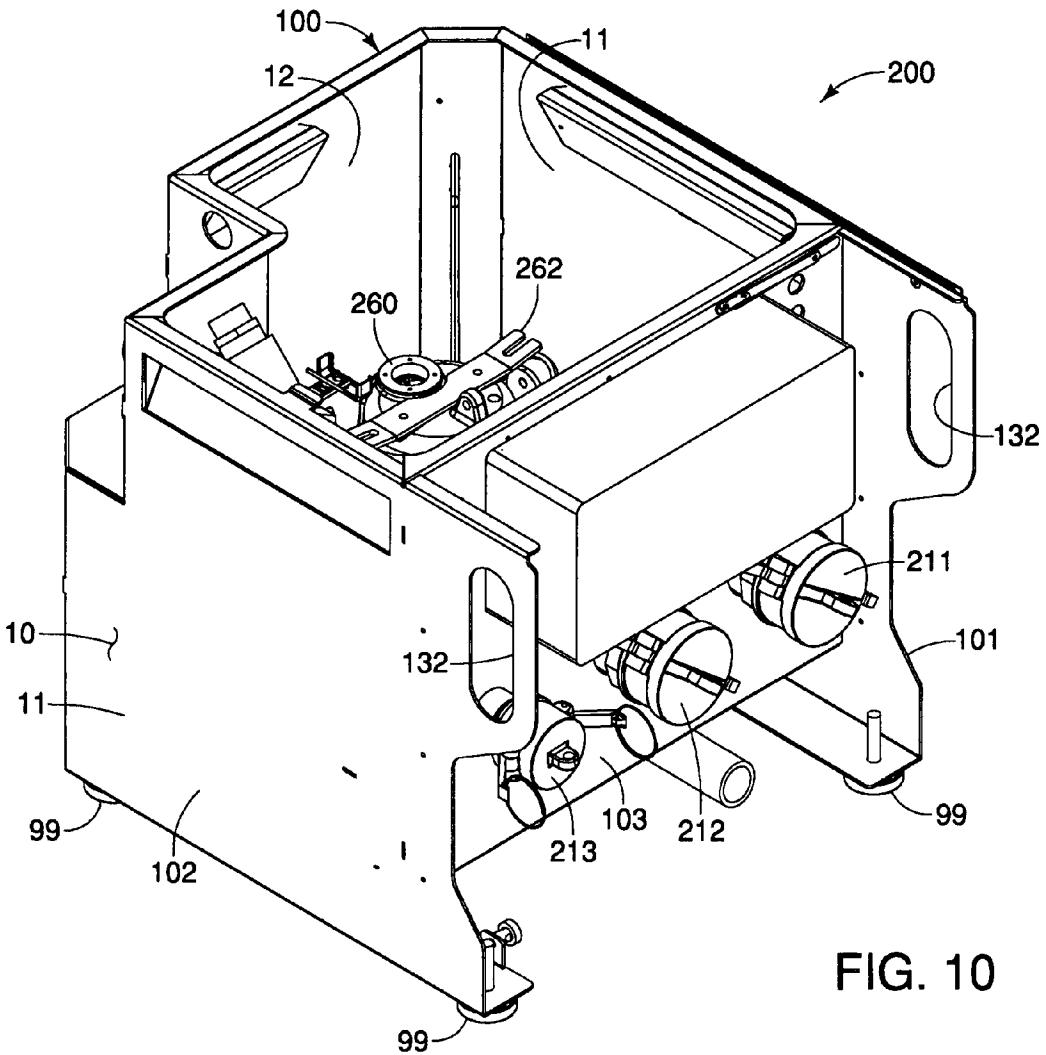
FIG. 10 is another isometric view of the apparatus depicted in FIG. 1, with the lid omitted.
Figure 11:
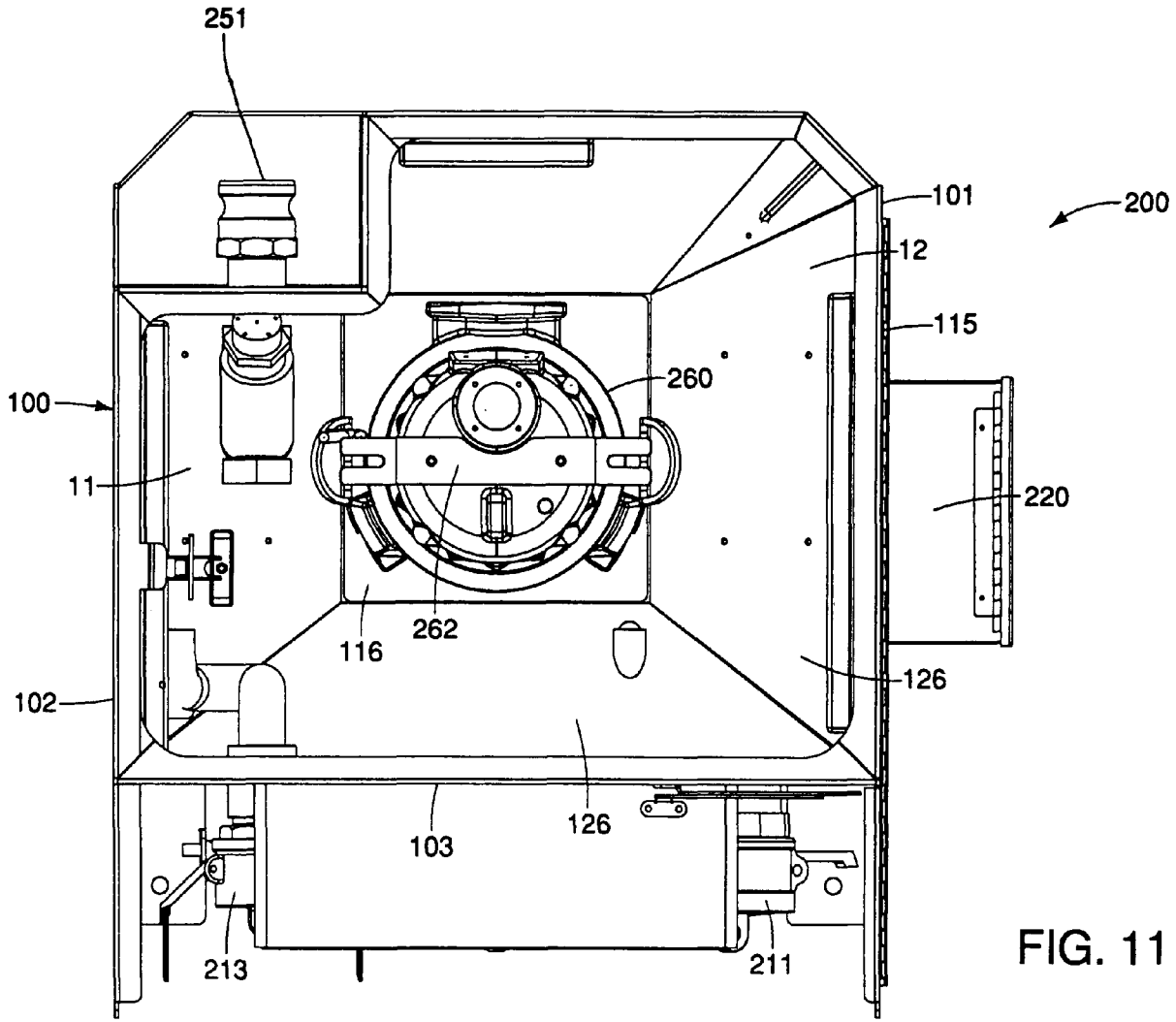
FIG. 11 is a top view of the apparatus depicted in FIG. 1, with the lid omitted.

With additional reference to the drawing figures, FIG. 10 is an isometric view of the apparatus 200 with the lid omitted for illustrative purposes, while FIG. 11 is a top view of the apparatus with the lid omitted for illustrative purposes. It is to be understood that various components of the apparatus as depicted in FIGS. 10 and 11 have been omitted for illustrative purposes, wherein such items include, but are not limited to various hoses, pipes and lines within the tank 100. As is seen, the apparatus 200 can include a pump 260. The pump 260 is adapted to facilitate expulsion from the tank 100 of at least a portion of its contents (not shown), which contents can include, for example, liquid waste such as sewage and/or waste drain water and the like. The pump 260 can be operatively disposed within the tank 100 as shown in FIG. 5. The pump 260 can be one of a number of specific types of pumps. For example, the pump 260 can be a grinder pump that is adapted to both expel from the tank 100, and to substantially liquefy and/or reduce to a substantially liquid state or to a slurry state, one or more types of solids and/or semi-solids typically found in sewage and/or waste drain water. The pump 260 can be supported substantially by the bottom wall 106 (shown in FIGS. 8 and 9) according to the exemplary embodiment of the disclosure. More specifically, the pump 260 (shown in FIGS. 10 and 11) can be substantially supported by and/or substantially above the center portion 116 (shown in FIGS. 8 and 9) of the bottom wall 106. With continuing reference to FIGS. 10 and 11, the pump 260 is at least partially supported and/or retained within the tank 100 by a retainer device 262. The retainer device 262 can be substantially in the form of a quick-release retainer device that is adapted to enable the pump to be removed from its retained position within the tank without the use of any type of tool. For example, the retainer device 262 can be substantially in the form of a manually operable clamping device that is adapted to selectively clamp the pump 260 against the bottom wall 106 (shown in FIGS. 8 and 9) of the tank 100.

With reference now to FIGS. 1-11, the apparatus 200 can be prepared for stowage and/or transport by removing the electrical box 220 from the receiver system 221, and stowing the electrical box inside the tank 100. Likewise, the lid 105 can be closed and secured to ready the apparatus 200 for stowage and/or transport. According to the exemplary embodiment of the disclosure, the apparatus 200 is dimensioned to fit within a standard shower stall, with the electrical box 220 removed from the receiver system 221. Conversely, the apparatus 200 can be prepared for use by removing the stowed electrical box 220 from within the tank 100, and mounting the electrical box in a supported position within the receiver system 221. Additionally, one or more inlet lines (not shown) can be connected to one or more of the inlets 211, 212, 213 of the apparatus 200. Such inlet lines can include, for example, waste water drain lines and/or sewage drain lines, otherwise sometimes known as gray water lines and black water lines, respectively. An outlet line (not shown) can be connected to the tank outlet 251 (shown in FIGS. 7 and 11). Such an outlet line can lead to a drain field, a settling pond, or a holding tank for example. Electrical power can also be connected to the apparatus for operation of the pump 260 and/or the heater 240 and/or other electrical devices such as, for example, pump controls, heater controls and/or level controls and the like.

When the apparatus 200 is in use according to the exemplary embodiment of the disclosure, one or more types of waste water can be introduced into the tank 100 by way of one or more of the inlets 211, 212, 213. Such waste water can then accumulate within the tank 100 before reaching a first predetermined level. A sensor (not shown) or the like can determine that the waste water has reached the first predetermined level within the tank 100, which can cause the pump 260 to begin pumping the accumulated waste water out of the tank by way of the outlet 251 until the waste water level within the tank reaches a second predetermined level, which can cause the pump to stop pumping. According to various embodiments of the present disclosure, one or more methods include utilizing and/or employing at least one apparatus according to respective embodiments of the present disclosure.

The preceding description has been presented only to illustrate and describe methods and apparatus in accordance with respective embodiments of the present invention. It is not intended to be exhaustive or to limit the disclosure to any precise form disclosed. Many modifications and variations are possible in light of the above teaching. It is intended that the scope of the invention be defined by the following claims.

What is claimed is:

1. A portable containment apparatus, comprising:

a tank defining an exterior surface, an interior surface, and an interior space adapted to contain liquid waste, the tank comprising:

a substantially flat, planar front wall;

a substantially flat, planar rear wall in substantially parallel offset juxtaposition relative to the front wall;

a substantially flat, planar first side wall in substantially perpendicular orientation relative to the front wall and to the rear wall;

a substantially flat, planar second side wall in substantially parallel offset juxtaposition relative to the first side wall;

a bottom wall comprising a substantially flat, planar center portion in substantially perpendicular orientation relative to each of the front wall, rear wall, first side wall and second side wall, the bottom wall further comprising a plurality of outer portions substantially surrounding the center portion, wherein each outer portion is sloped relative to the center portion;

an inlet through which liquid waste is introduced into the tank to be contained therein;

an outlet through which at least a portion of liquid waste contained within the tank can be expelled from the tank;

a grinder pump operatively disposed within the interior space and adapted to expel at least a portion of liquid waste contained within the tank by way of the outlet;

a heater affixed to the outer surface at a predetermined outer sloped portion of the bottom wall, the heater being adapted to transfer heat energy through the bottom wall to liquid waste contained within the interior space;

a substantially flat, planar lid adapted to be selectively placed in an open position in which access to the interior space is provided, and in a closed position in which the interior space is substantially sealed;

an electrical distribution box adapted to be removably supported on the exterior surface at a predetermined side wall, the distribution box further adapted to be selectively stowed within the interior space when removed from its supported position on the exterior surface;

a receiver system connected to the exterior surface at a predetermined side wall, the receiver system adapted to receive the electrical distribution box in a removably supported position;

a powder coating affixed to the interior and to the exterior surface of the tank.

2. The apparatus according to claim 1, wherein the grinder pump is supported substantially by the center portion of the bottom wall.

3. The apparatus according to claim 1, comprising three fluid waste inlets and a single fluid waste outlet.

4. The apparatus according to claim 1, wherein each of the first side wall and the second side wall comprises a respective inwardly extending lower flange substantially parallel to the center portion of the bottom wall.

5. The apparatus according to claim 1, wherein each of the first side wall and the second side wall comprises a respective inwardly extending lower flange substantially parallel to the center portion of the bottom wall, the apparatus further comprising a plurality of height-adjustable feet supported on the flanges.

6. The apparatus according to claim 1, wherein each of the first side wall, the second side wall, and the rear wall define respective substantially flush handholds adapted for lifting the apparatus.

7. The apparatus according to claim 1, wherein the lid is pivotally attached to the remainder of the tank.

8. The apparatus according to claim 1, wherein the tank further comprises:

a first beveled wall portion disposed between the first side wall and the rear wall; and a second beveled wall portion disposed between the second side wall and the rear wall.

9. The apparatus according to claim 1, further comprising a clamp device adapted to removably retain the grinder pump in an operative position within the interior space.

* * * * *